US006431682B1

(12) United States Patent
Osada et al.

(10) Patent No.: US 6,431,682 B1
(45) Date of Patent: Aug. 13, 2002

(54) LIQUID DISCHARGE HEAD, METHOD OF MANUFACTURING THE LIQUID DISCHARGE HEAD, AND LIQUID DISCHARGE RECORDING APPARATUS USING THE LIQUID DISCHARGE HEAD

(75) Inventors: Torachika Osada, Yamato; Masami Kasamoto, Ayase; Hiroyuki Ishinaga, Tokyo; Haruhiko Terai; Genji Inada, both of Yokohama; Junji Tatsumi, Kawasaki; Hiroyuki Sugiyama, Sagamihara; Ken Ikegame, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/576,246

(22) Filed: May 24, 2000

(30) Foreign Application Priority Data

May 27, 1999 (JP) ..... 11-148900

(51) Int. Cl.[7] ..... B41J 2/14; B41J 2/16; B41J 2/05

(52) U.S. Cl. ..... 347/47; 347/65

(58) Field of Search ..... 347/65, 63, 56, 347/54, 47, 44, 20, 67, 40, 42, 43

(56) References Cited

U.S. PATENT DOCUMENTS

| | | | | |
|---|---|---|---|---|
| 5,059,973 A | | 10/1991 | Watanabe | 397/56 |
| 5,208,604 A | | 5/1993 | Watanabe et al. | 347/47 |
| 5,604,521 A | * | 2/1997 | Merkel et al. | 347/47 |
| 5,682,187 A | | 10/1997 | Watanabe et al. | 347/45 |
| 5,748,213 A | | 5/1998 | Karita et al. | 347/63 |
| 5,774,145 A | * | 6/1998 | Morita et al. | 347/47 |
| 5,784,079 A | * | 7/1998 | Masuda et al. | 347/20 |
| 5,933,163 A | | 8/1999 | Koizumi et al. | 347/42 |

FOREIGN PATENT DOCUMENTS

| | | | | |
|---|---|---|---|---|
| JP | 2-187342 | | 7/1990 | B41J/2/045 |
| JP | 2-204048 | | 8/1990 | B41J/2/045 |
| JP | 5-147213 | * | 6/1993 | B41J/2/45 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

It is an object of the present invention to ensure a desired precision in positioning an orifice plate with respect to liquid flow paths of a head main body, so as to prevent a failure liquid discharge which will possibly be caused due to a problem involved in a process of forming the orifice holes. In detail, a head main body is formed on the lower wall thereof a plurality of heating elements, has a plurality of liquid flow paths formed by dividing an internal space with a plurality of liquid flow path walls and arranged in parallel relationship with one another. On either side of the plurality of the liquid flow paths there are formed two dummy liquid flow paths. An orifice plate is formed with a plurality of orifice holes arranged in parallel with one another for discharging ink. Further, on either side of the plurality of the orifice holes there are formed two projected portions so shaped that they are capable of engaging with the opening ends of the dummy liquid flow paths. Each of the projected portions is formed with a dummy orifice hole which is not used for discharging ink during recording operation. A desired positioning can be effected by engaging the projected portions of the orifice plate with the dummy liquid flow paths.

17 Claims, 14 Drawing Sheets

LIQUID DISCHARGE HEAD, METHOD OF MANUFACTURING THE LIQUID DISCHARGE HEAD, AND LIQUID DISCHARGE RECORDING APPARATUS USING THE LIQUID DISCHARGE HEAD

BACKGROUND OF THE INVENTION

1. Field of the Invention

The present invention relates to a liquid discharge head which is capable of discharging a liquid so as to form great many flying liquid drops, thereby effecting a desired recording operation. The present invention also relates to a method of manufacturing the liquid discharge head and a liquid discharge recording apparatus using the liquid discharge head. In particular, this invention relates to an orifice plate formed with a number of liquid discharge holes (herein after, referred to as orifice holes).

However, in the present invention, the term "recording" is used to mean not only an operation in which an image that is a character or a picture is recorded on a recording medium, but also another kind of operation for recording an image that is a pattern not having a certain specific meaning.

2. Description of the Related Art

In the past, there has been known an ink jet recording apparatus in which a sort of recording liquid (ink) is discharged through a number of orifice holes formed on a liquid discharge head so that a predetermined recording operation may be effected in a desired manner. In particular, such kind of ink jet recording apparatus has been considered to be an excellent recording apparatus since it can perform a recording operation at a high recording speed with only a low noise.

FIG. 14 is an explanatory perspective view which is used to serve as an example indicating a conventional liquid discharge head of the type mentioned in the above. In detail, the liquid discharge head shown in FIG. 14, comprises a substrate plate 1001, a top plate 1002 and an orifice plate 1004. The substrate plate 1001 has a plurality of heating elements 1005 which serve as energy generating elements for generating a necessary amount of energy needed for effecting a desired ink discharge. The top plate 1002 is provided on the upper surface of the substrate plate 1001 and has a plurality of grooves each serving as a liquid flowing path 1006, located in positions corresponding to the heating elements 1005. The orifice plate 1004 is provided in contact with the end faces of both the substrate plate 1001 and the top plate 1002, and has a plurality of ink discharge orifice holes 1012 formed in positions communicated with the above ink flowing paths 1006.

In more detail, the orifice holes 1012 formed on the orifice plate 1004 are extremely small in their sizes. In fact, how these orifice holes 1012 are formed will have an important influence on the discharge characteristic of the liquid discharge head. Namely, as far as the orifice plate 1004 of the liquid discharge head is concerned, since extremely small orifice holes 1012 are to be formed, it is required that the orifice plate 1004 as a whole should have an excellent workability (easy to be shaped into any desired shape). Further, since the orifice plate is in direct contact with the ink, the plate itself is required to have a sufficient ink resistance (not easy to be corroded by the ink).

As a material which can be used to form the orifice plate 1004 and which can satisfy the above requirements, it has been allowed to use a thin metal sheet made of SUS, Ni, Cr or Al. Also, it has been allowed to use one of the following several kinds of resin films whose thickness and properties are easy to achieve at a low cost. In detail, these resin films may be made of polyamide, polysulfone, polyether sulfone, polyphenylene oxide, polyphenylene sulfide, or polyproplene.

On the other hand, with the progress and development of the recording technique during recent years, it has been required that the recording operation should be performed at a high speed with a high precision. For this reason, the size (diameter) of each orifice hole is required to be further smaller and the orifice holes are needed to be arranged on the orifice plate with an increased density. In order to meet these requirements, there have been suggested various improved methods for forming the orifice holes. For example, when the orifice plate is made of a resin film, these orifice holes may be formed by virtue of laser treatment which is suitable for forming fine small holes. Further, when a metal is used to manufacture the orifice plate, the orifice holes may be formed with the use of an electrocasting method.

However, when the orifice holes are arranged with an increased density and each of the orifice holes has become smaller, a problem will be that orifice plate having orifice holes formed thereon will be difficult to be combined correctly with the liquid flow paths without forming any gaps. To cope with the above problem, Japanese Patent Laid-Open No. 2-187342 has disclosed an improved method in which an orifice plate made of a resin film is at first combined with a head main body which was previously formed by combining together a substrate plate and a top plate, then a laser treatment is used so as to form orifice holes on the orifice plate. Further, Japanese Patent Laid-Open No. 204048 has suggested another improved method shown in FIG. 15. As shown in the drawing, an orifice plate 1024 made of a resin such as a dry film is at first softened by adding heat. The softened orifice plate 1024 is then pressed on to the combining surface of a head main body 1023 which was previously formed by combining together a substrate plate 1021 and a top plate 1022, so that the orifice plate 1024 may be partially combined with a plurality of liquid flow paths 1026 formed on the head main body. Subsequently, a photolithography technique or a laser treatment is employed to form a desired liquid discharge head having a plurality of orifice holes 1032 located in positions corresponding to the liquid flow paths 1026.

On the other hand, in order to ensure a stabilized direction for ink discharge, the diameter of each orifice hole should be made smaller along its ink discharge direction. Namely, it is preferred that each orifice hole be formed into a taper configuration. However, in the process of forming tapered orifice holes, it is preferred that a plurality of orifice holes are at first formed in the orifice plate, followed by combining the orifice plate on to the head main body. In fact, such kind of orifice plate is so formed that the portions surrounding each orifice hole is projected towards the head main body. In this way, by engaging the projected portions into the liquid flow paths of the head main body, the positioning of the orifice plate on to the head main body may be made easy.

However, there are at least the following problems associated with the above described conventional liquid discharge head.

Namely, in the above discussed method, an orifice plate is made of a resin film such as a dry film, the formed orifice plate is then softened by adding a heat. Subsequently, the softened orifice plate is then pressed on to the combining surface of a head main body, so that the orifice plate may be partially combined into a plurality of liquid flow paths formed in the head main body. In this way, although it is allowed to ensure a desired precision when the plurality of orifice holes are engaged with the liquid flow paths, there had been existing the following problems.

A first problem is that when the softened orifice plate is pressed on to the combining surface of the head main body, it will be difficult to control an amount of the resin invading into the liquid flow paths. Further, if the diameter of each orifice hole is extremely small and these orifice holes are arranged with a high density, an amount of resin invaded into the liquid flow paths will greatly affect the liquid discharge characteristic of the liquid discharge head, undesirably making a liquid discharge amount of one liquid flow path different from that of the other.

Moreover, when a resin film is used to form an orifice plate, the orifice holes are formed by virtue of laser treatment. However, if the laser treatment is conducted after the orifice plate has been combined on to the head main body, some kinds of extraneous materials caused due to ablation in the laser treatment will invade into the liquid flow paths. If such extraneous materials get into the liquid flow paths, the orifice holes will get choked. As a result, these extraneous materials will adhere on to the heating elements, rendering it difficult to discharge ink through these orifice holes. On the other hand, when the orifice plate is so formed that the surrounding portion of each orifice hole is projected towards the head main body, all the projected surrounding portions may be engaged into the liquid flow paths of the liquid discharge head, so that the positioning of the orifice plate on to the head main body may be made easy with a high precision, However, since all the projected portions have to be engaged into the liquid flow paths, it will be difficult to make an easy management on an engagement tolerance between the projected portions and the liquid flow paths. On the other hand, if such engagement tolerance is alleviated, it will be difficult to ensure a necessary precision in positioning the orifice holes with respect to the liquid discharge paths. Moreover, if the engagement tolerance is alleviated, a position of one projected portion engaged with one liquid flow path will be different one from the other. As a result, it will be difficult to manufacture a liquid discharge head whose orifice holes can uniformly discharge liquid without any irregularity.

SUMMARY OF THE INVENTION

In view of the above, it is an object of the present invention to provide a liquid discharge head capable of ensuring a precision in positioning orifice holes of an orifice plate with respect to the liquid flow paths, preventing any possible failure liquid discharge which will otherwise be caused by a defect in forming the orifice holes. It is another object of the present invention to provide a method of manufacturing the liquid discharge head and a liquid discharge recording apparatus using the liquid discharge head.

In order to achieve the above objects, the liquid discharge head according to the present invention, is equipped with a plurality of energy generating elements capable of generating energy for use in liquid discharge, including a head main body having a plurality of liquid flow paths arranged in parallel with one another corresponding to the energy generating elements, said liquid flow paths having their openings formed on one end face of the head main body, further including an orifice plate having a plurality of orifice holes communicated with the liquid flow paths, so that the liquid discharge head is capable of performing a recording operation on a recording medium by discharging liquid through the orifice holes, characterized in that:

the head main body has a plurality of dummy liquid flow paths which will not be used in a recording operation but are provided on either side of the plurality of the liquid flow paths and are arranged in parallel with these liquid flow paths, while the orifice plate has, on its combining surface for combining with the head main body and in positions corresponding to the dummy liquid flow paths, a plurality of projected portions capable of engaging with open ends of the dummy liquid flow paths.

The liquid discharge head of the present invention formed in the above manner, has a plurality of dummy liquid flow paths which will not be used in a recording operation but are provided on either side of the plurality of the liquid flow paths, while the orifice plate has, on its combining surface with the head main body and in positions corresponding to the dummy liquid flow paths, a plurality of projected portions capable of engaging with open ends of the dummy liquid flow paths. Therefore, when the orifice plate is to be combined with the head main body, it is allowed to easily effect the positioning of the orifice holes with respect to the liquid flow paths, simply by engaging the projected portions of the orifice plate with the dummy liquid flow paths.

Further, there is also provided a method of manufacturing a liquid discharge head of the present invention, which is equipped with a plurality of energy generating elements capable of generating energy for use in liquid discharge, includes a head main body having a plurality of liquid flow paths arranged in parallel with one another corresponding to the energy generating elements, the liquid flow paths having their openings formed on one end face of the head main body, further includes an orifice plate having a plurality of orifice holes communicated with the liquid flow paths, so that the liquid discharge head is capable of performing a recording operation on a recording medium by discharging liquid through the orifice holes, characterized in that the method comprises the steps of:

forming a plurality of dummy liquid flow paths which are provided on either side of the plurality of the liquid flow paths and in parallel with these liquid flow paths;

forming a plurality of projected portions capable of engaging with open ends of the dummy liquid flow paths, with the projected portions located in positions corresponding to the dummy liquid flow paths and formed on the orifice plate's combining surface for being combined with the head main body;

combining the orifice plate with the head main body after the projected portions are combined with the open ends of the dummy liquid flow paths for effecting the positioning of the liquid flow paths with respect to the orifice holes.

With the use of the method for manufacturing a liquid discharge head of the present invention, since it is allowed to form the dummy liquid flow paths in the same process for forming the liquid flow paths (capable of discharging liquid) in the head main body, it has become possible to manufacture a liquid discharge head having a high positioning precision, without a necessity of increasing production steps.

Moreover, even when each projected portion is formed with a dummy orifice hole which does not discharge liquid during recording operation, since it is allowed to form the dummy liquid flow paths in the same process for forming the liquid flow paths (capable of discharging liquid) in the head main body, it is not necessary to have additional production steps for forming the dummy orifice holes.

In addition, when a laser light is used to form orifice holes and to form dummy orifice holes (not for discharging liquid during a recording operation) in the projected portions, the orifice holes and the dummy orifice holes are all formed into tapered configurations. Although these tapered holes have the same angles, the diameters of the liquid discharge openings of the dummy orifice holes will become smaller than those of the liquid discharge openings of the orifice holes, at an extent corresponding to the thickness of the projected portions. For this reason, it is allowed to easily distinguish the orifice holes from the dummy orifice holes, thereby rendering it easy to effect the positioning of the projected portions with respect to the dummy liquid flow paths.

BRIEF DESCRIPTION OF THE DRAWINGS

FIG. 5A', FIG. 5B' and FIG. 5C' are respectively cross sectional views each formed by taken along C—C line in FIG. 5A, FIG. 5B and FIG. 5C;

DESCRIPTION OF THE PREFERRED EMBODIMENTS

Several embodiments of the present invention will be described in the following with reference to the accompanying drawings.

First Embodiment

Figure 1:
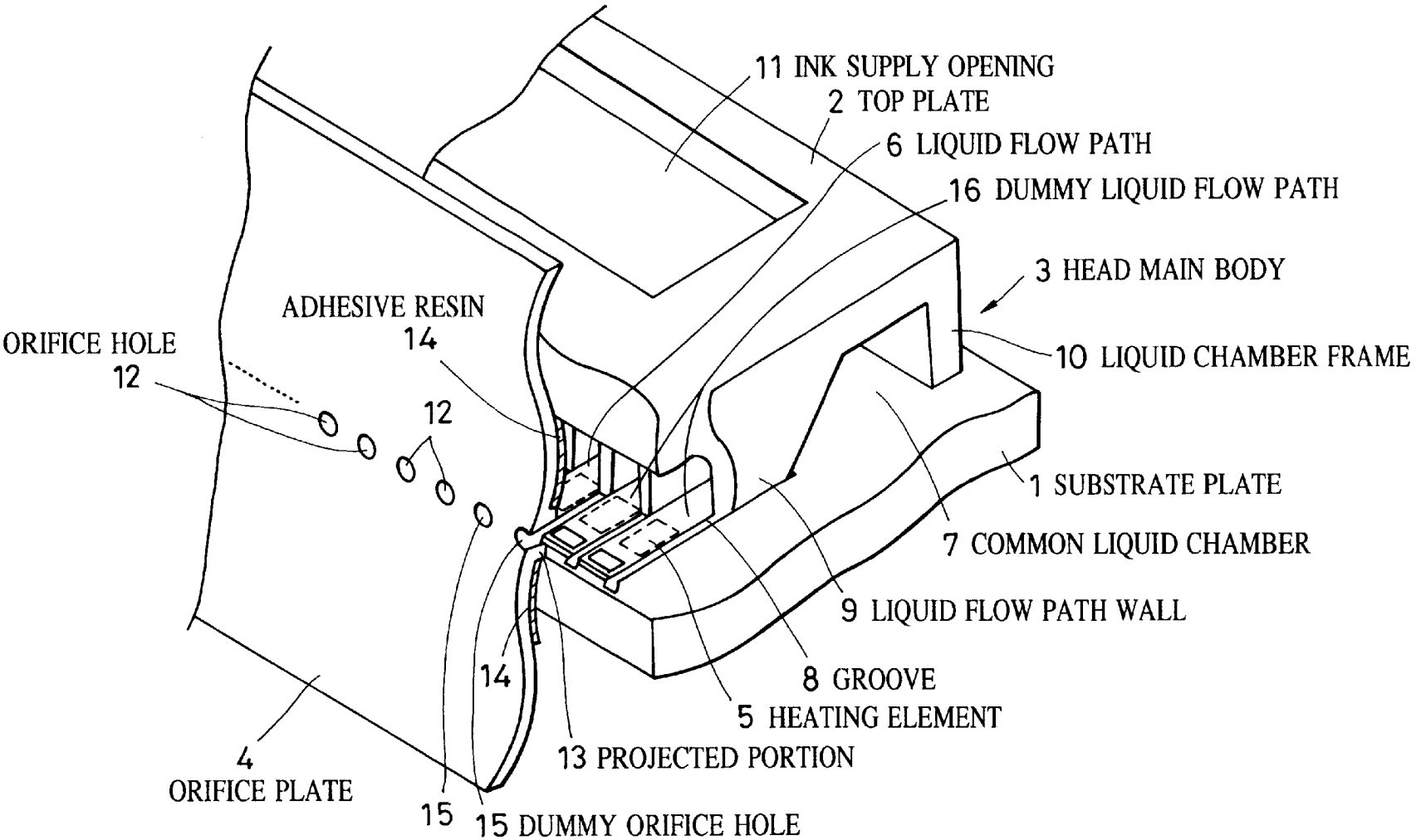
FIG. 1 is a partially broken perspective view indicating a liquid discharge head made according to a first embodiment of the present invention.
Figure 2:
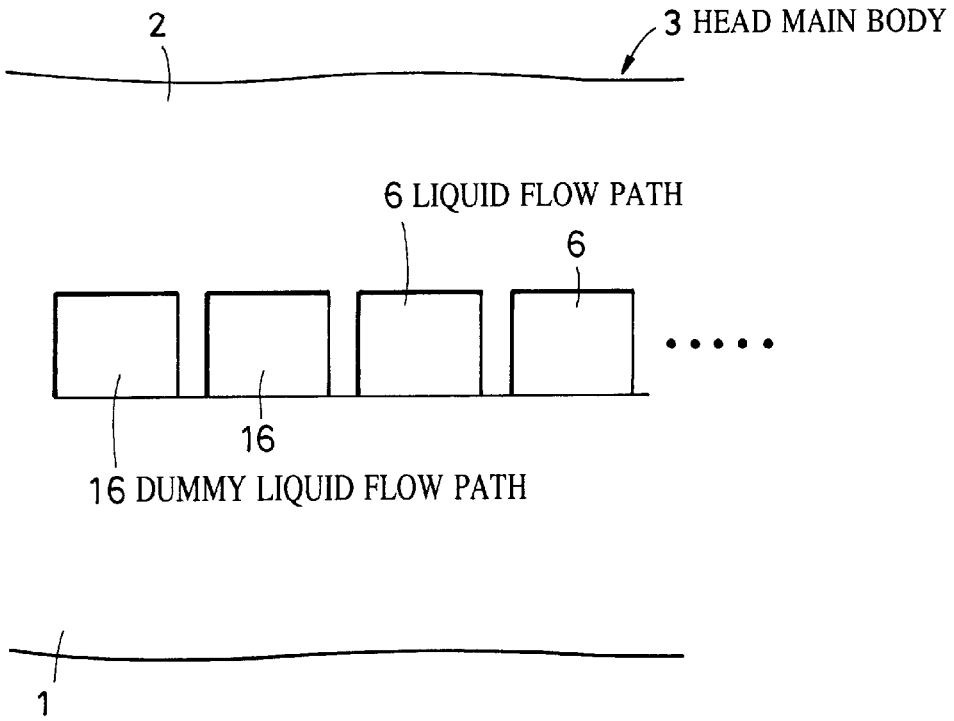
FIG. 2 is an explanatory view indicating a condition in which the liquid discharge head main body shown in FIG. 1 is viewed from a combining surface for combining an orifice plate.

FIG. 1 is a partially broken perspective view indicating a liquid discharge head made according to a first embodiment of the present invention. FIG. 2 is an explanatory view indicating a condition in which a liquid discharge head main body 3 shown in FIG. 1 is viewed from a combining surface for combining an orifice plate 4.

As shown in FIG. 1, the liquid discharge head according to the present embodiment comprises a head main body 3 and an orifice plate 4 combined with the head main body 3. The head main body 3 has a plurality of heating elements 5 serving as energy generating elements for producing discharge energy to ink, and has a plurality of liquid flow paths 6 and a plurality of dummy liquid flow paths 16 located corresponding to the heating elements 5. The dummy liquid flow paths 16, as will be described later, can not be actually used in a recording operation. However, since the dummy liquid flow paths 16 have the same structure as that of the liquid flow paths 6, the structure on either side of the plurality of the liquid flow paths 6 will be referred to as "dummy liquid flow path" in the present specification.

The head main body 3, as shown in FIG. 2, has on both end faces thereof a plurality of openings communicated with the liquid flow paths 6 and the dummy liquid flow paths 16. The orifice plate 4 is combined with one end face of the head main body 3. However, in the present embodiment, there are two dummy liquid flow paths 16 formed on either side of the plurality of the liquid flow path 6 arranged in parallel with one another. Thus, there are four such kind of dummy liquid flow paths 16 which are formed in the head main body 3 and arranged in parallel with the liquid flow paths 16 (see FIG. 8). Since these dummy liquid flow paths 16 are allowed to be formed in the same and identical process for forming the liquid flow paths 6, the total steps involved in the manufacturing process will remain the same.

Further, the orifice plate 4 has a plurality of dummy orifice holes 15 communicated with the dummy liquid flow path 16, with each dummy orifice hole 15 being surrounded by a projected portion 13. Moreover, the orifice plate 4 has a plurality of orifice holes 12 communicated with the liquid flow paths 6. Similarly, since these dummy orifice holes 15 are allowed to be formed in the same and identical process for forming the orifice holes 12, the total steps involved in the manufacturing process will remain the same.

The head main body 3 comprises a substrate plate 1 and a top plate 2 combined with the upper surface of the substrate plate 1. The substrate plate 1 has formed thereon a plurality of heating elements 5. Al wiring arrangement is effected by film formation technique in order that electric signals may be supplied to the heating elements 5. The top plate 2 has a plurality of liquid flow path walls 9 which are used to divide the internal space of the head main body 3 to form a plurality of liquid flow paths 6 and a plurality of dummy liquid flow paths 16. In addition, the top plate 2 is integrally formed with a liquid chamber frame structure 10 which is used to form a common liquid chamber 7 for temporarily holding an amount of ink to be supplied to the liquid flow paths 6 and the dummy liquid flow paths 16. In this way, the liquid flow paths 6, the dummy liquid flow paths 16 and the common liquid chamber 7 can be formed by combining the top plate 2 on to the substrate plate 1. Further, the top plate 2 is formed with an ink supply opening 11 so that an amount of ink can be supplied from the outside into the common liquid chamber 7. Moreover, between every two heating elements on the substrate plate 1, there is formed a groove 8 capable of receiving a liquid flow path wall 9 of the top plate 2. Thus, when the top plate 2 is combined with the substrate plate 1, the positioning of the top plate 2 on the substrate plate 1 can be made extremely easy simply by engaging the liquid flow path walls 9 into the grooves 8.

In use of the liquid discharge head, the ink supplied from the common liquid chamber 7 to the liquid flow paths 6 and to the dummy liquid flow paths 16, will present a meniscus liquid section in each of the orifice holes 12 so as to fill the liquid flow paths 6 and the dummy liquid flow paths 16. In this manner, once the heating elements 5 are driven so as to generate heat, the ink over the heating elements 5 will be rapidly heated, so that air bubbles will occur during a phenomenon called film boiling in the liquid flow path 6, thereby enabling the ink to be discharged through the orifice holes 12 by virtue of a pressure formed due to the growth of the air bubbles. On the other hand, since the heating elements 5 provided within the dummy liquid flow paths 16 are not driven during the recording operation of the ink discharge head, there would be no ink to be discharged through the dummy orifice holes 15.

Here, a more detailed description will be given to the orifice plate 4 with reference to the accompanying drawings.

Figure 3A:
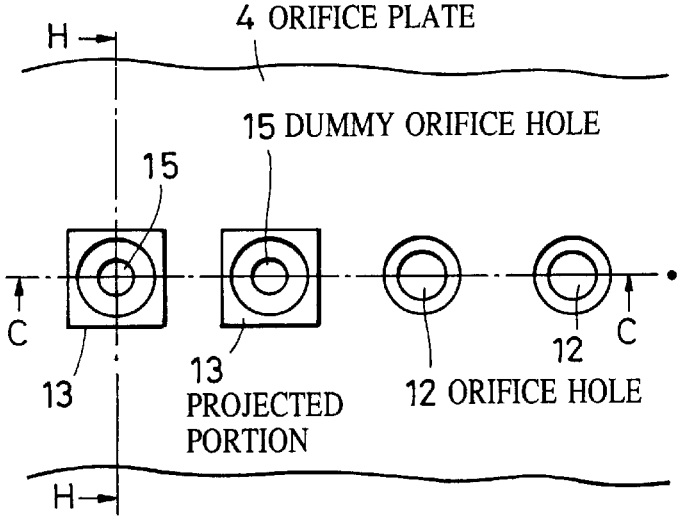
FIG. 3A is a plane view indicating a condition in which an orifice plate is partially viewed from the head main body side.
Figure 3B:
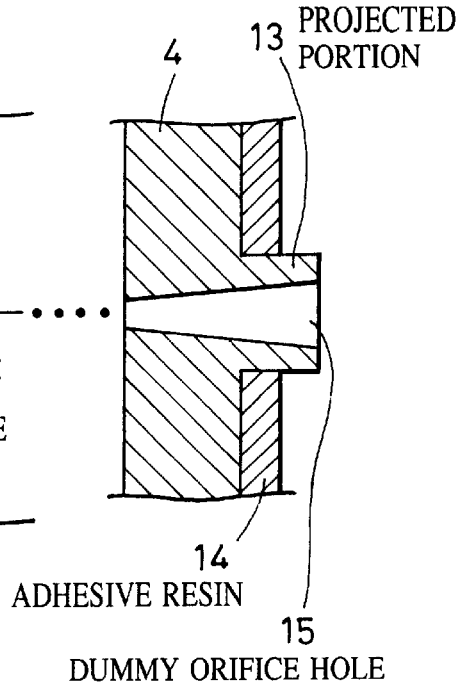
FIG. 3B is a cross sectional view taken along line H—H in FIG. 3A, indicating a condition in which the orifice plate has been partially coated with an adhesive resin.

FIG. 3A is a plane view indicating a condition in which the orifice plate 4 is partially viewed from the head main body side. FIG. 3B is a cross sectional view taken along line H—H in FIG. 3A, indicating a condition in which the orifice plate is partially coated with an adhesive resin.

Figure 4A:
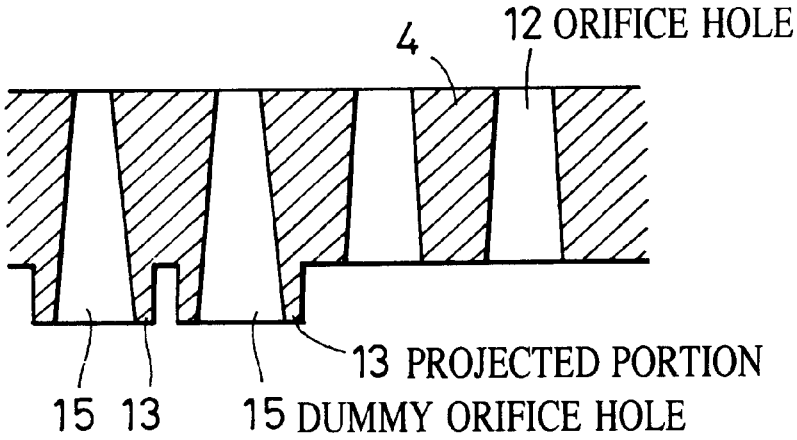
FIG. 4A is a cross sectional view taken along line C—C in FIG. 3A.
Figure 4B:
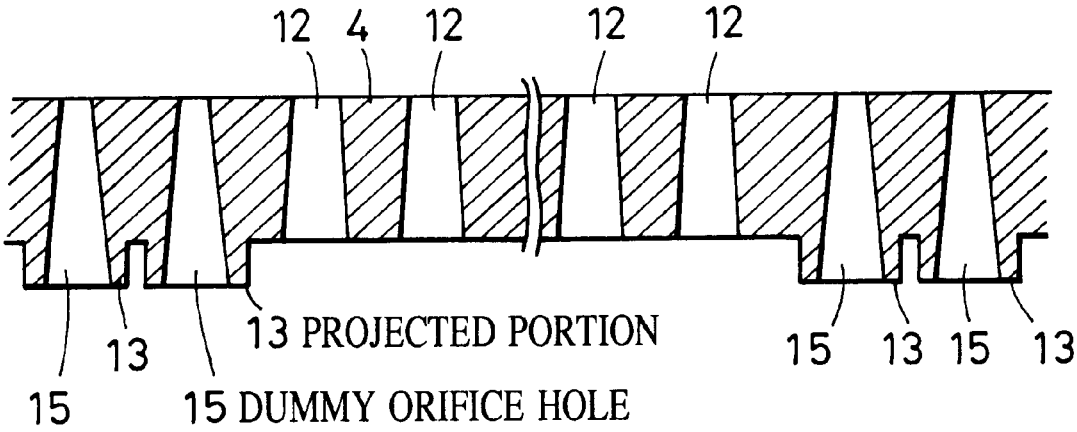
FIG. 4B is a cross sectional view indicating a condition in which a plurality of dummy orifice holes are formed on either side of the plurality of the orifice holes arranged in parallel with each other.

FIG. 4A is a cross sectional view taken along line C—C in FIG. 3A. FIG. 4B is a cross sectional view indicating a condition in which a plurality of dummy orifice holes 15 are formed on either side of the plurality of orifice holes 12 arranged in parallel with each other.

In practice, the orifice plate 4 is formed with a plurality of orifice holes 12 arranged in parallel with one another. Two projected portions 13 are formed on either side of the plurality of orifice holes 12, so that there are four such projected portions 13 in all, with each projected portion 13 surrounding a dummy orifice hole 15.

In fact, the orifice plate 4 has a thickness of 25 $\mu$m, each projected portion 13 has been formed into a square projection having a square cross section. In detail, each projected portion 13 has a length of 30 $\mu$m, a width of 30 $\mu$m and a height of 10 $\mu$m. These orifice holes 12 are arranged at an interval corresponding to a resolution whose pitch is 600 dpi, with each orifice hole being in tapered configuration. In more detail, the inlet opening of each orifice hole 12 has a diameter of 32 $\mu$m, while the outlet opening of each orifice hole 12 has a diameter of 24 $\mu$m. On the other hand, the outlet opening of each dummy orifice hole 15 is smaller than 24 $\mu$m which is a diameter of the outlet opening of an orifice hole 12, for the reason that will be discussed later for explaining a process of forming the orifice holes 12 and a process of forming the dummy orifice holes 15.

In fact, the orifice plate 4 may be made of a metal film such as SUS or Ni. Alternatively, it can be made of a plastic material which is a resin film having an excellent ink corrosion resistance. Such a resin film may be made of polyamide, polysulfone, polyether sulfone, polyphenylene oxide, polyphenylene sulfide or polypropylene.

Further, as an adhesive resin 14 for bonding together the orifice plate 4 and the head main body 3, it is allowed to use the following materials. For example, it is allowed to use an adhesive resin which, upon being treated by one or more of ultraviolet light irradiation, infrared light irradiation and heating treatment, will be in a state called B-stage (an intermediate hardened state) so as to be hardened and shrunken while still maintaining its tack property (adhesion property). In the present embodiment, what was used as an adhesive agent is an epoxy resin which, upon being irradiated by an ultraviolet light of 1 mW/cm$^2$ for 60 seconds, will be in a B-stage, and will be hardened upon UV irradiation or heating treatment. However, such kind of an adhesive agent can also produce an adhesive effect even if a used treatment is only a heated pressing treatment.

Figure 6:
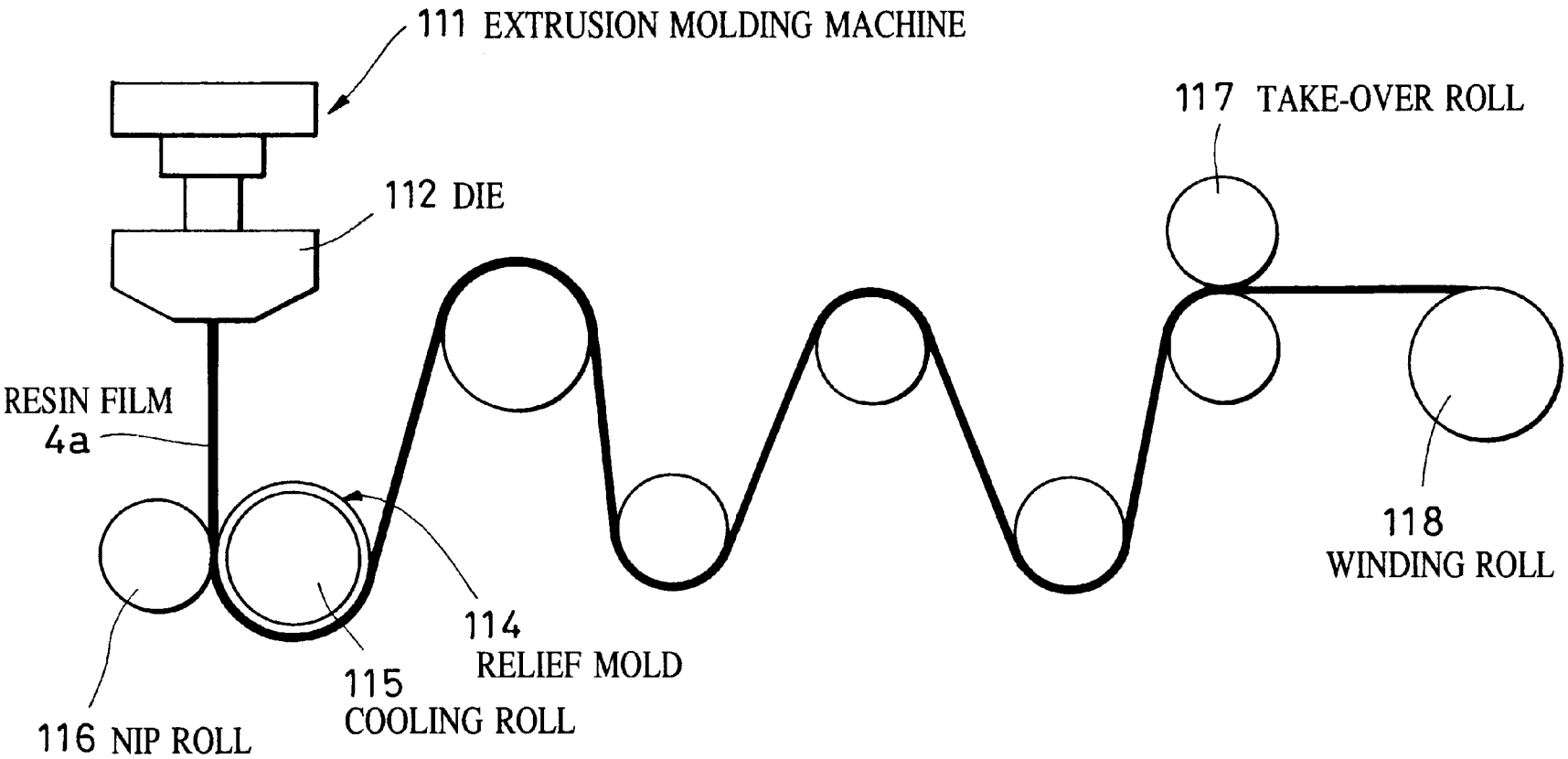
FIG. 6 is an explanatory view schematically indicating an apparatus for manufacturing a resin film, representing a part of a production line for manufacturing the liquid discharge head according to the present embodiment.
Figure 7:
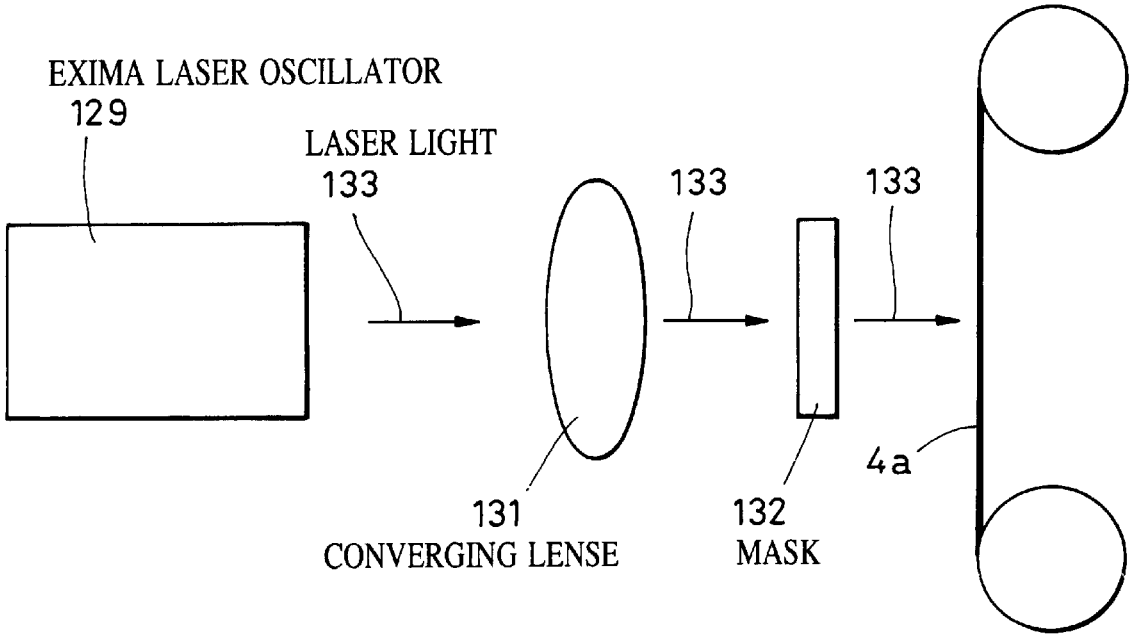
FIG. 7 is an explanatory view schematically indicating an exima laser treatment apparatus for forming the orifice holes and the dummy orifice holes on the resin film.

Next, a process for forming the orifice holes 12 and dummy holes 15 on the orifice plate 4 will be described with reference to FIG. 5, FIG. 6 and FIG. 7. In detail, FIG. 5A', FIG. 5B' and FIG. 5C' are respectively cross sectional views each taken along the line C—C in FIG. 5A, FIG. 5B, and FIG. 5C, respectively. Here, FIG. 6 is an explanatory view schematically indicating an apparatus for manufacturing a resin film 4*a*, representing a part of a production line for manufacturing the liquid discharge head according to the present embodiment. Further, FIG. 7 is an explanatory view schematically indicating an excimer laser treatment apparatus for forming the orifice holes 12 and the dummy orifice holes 15 on the resin film 4*a*.

Figure 5A:
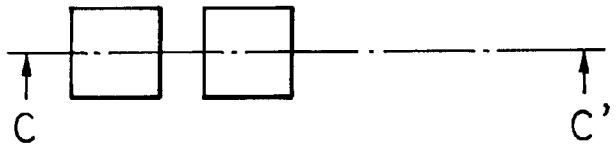
FIG. 5A, FIG. 5B and FIG. 5C are explanatory views schematically indicating various steps in a process of forming the orifice holes and the dummy orifice holes.
Figure 5A:
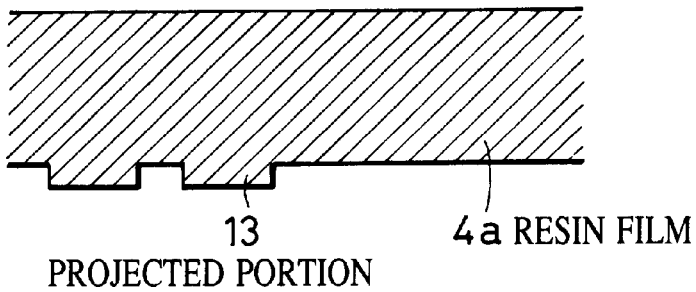

At first, as shown in FIG. 5A and FIG. 5A', a resin film 4*a* is formed which includes a plurality of projected portions 13. In detail, the resin film 4*a* has a thickness of 25 $\mu$m, each projected portion 13 has a height of 10 $\mu$m and a thickness of 35 $\mu$m.

FIG. 6 is an explanatory view schematically indicating a process in which a molten resin is extruded so as to be formed into a resin film, with the use of an extrusion molding machine. Next, a roll equipped with a relief mold having a predetermined shape is pressed on to the surface of the resin film, thereby forming a desired pattern on the surface of the resin film. In practice, an amount of molten resin is extruded through a die 112 of an extrusion molding machine 111, and is squeezed between a cooling roll 115 and a nip roll 116, so as to be pressed by these rolls. At this time, a relief mold 114 having a shape corresponding to the projected portions 13 (shown in FIG. 5A) may be attached to the surface of the cooling roll 115. With the use of the relief mold 114, it is allowed to continuously form desired patterns on the surface of the resin film 4*a*.

In this way, a desired pattern may be formed on the surface of the resin film 4*a* with the use of the relief mold 114, and the resin film 4*a* itself is cooled by the cooling roll 115. Next, the resin film 4*a* is passed over several other rolls and two take-over rolls 117 before being wound around a winding roll 118.

Figure 5B:
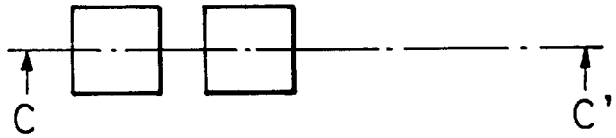
Figure 5B:
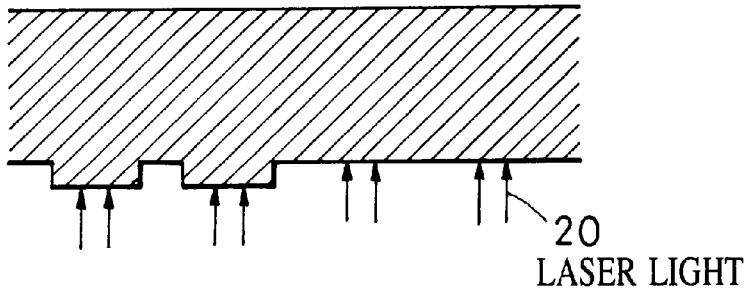
Figure 5C:
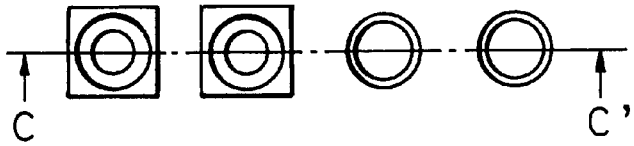
Figure 5C:
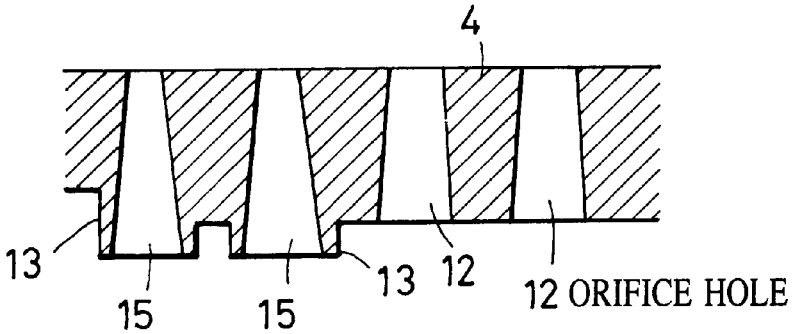

Further, as shown in FIG. 5B', central portion of the resin film, on which the orifice holes 12 and the dummy orifice holes 15 are to be formed, is irradiated with a laser 20. Thus, as shown in FIG. 5C and FIG. 5C', several tapered through holes (which are the orifice holes 14 and the dummy orifice holes 15) will be formed through the resin film 4*a*. At this time, since each dummy orifice hole 15 is surrounded by a projected portion 13, the thickness of the resin film at these portions will be 10 $\mu$m thicker than other portions. For this reason, even though the taper angle of each through hole is all the same as one another, the diameter of the outlet opening of each dummy orifice hole 15 is smaller than the diameter of the outlet opening of each orifice hole 12.

The excimer laser treatment apparatus shown in FIG. 7 comprises an excimer laser oscillator 129, a converging lens 131 for converging the light 133 emitted from the excimer laser oscillator 129, and a mask 132 for directing the laser light 133 passing through the converging lens 131 on to some predetermined portions of the resin film 4*a*. The laser light emitted from the excimer laser oscillator 129 is passed through the converging lens 131 and the mask 132 so as to irradiate the resin film 4*a*. In the present embodiment, the resin film 4*a* is rolled upon itself so as to be received into a predetermined place. In use, the rolled resin film 4*a* is pulled out and part of it is made flat which is then irradiated by a laser light 133.

Although in the present embodiment it has been illustrated that the production line shown in FIG. 6 and the laser treatment apparatus shown in FIG. 7 are set separately from each other, they are allowed to be connected together in a continuous manner.

Figure 8:
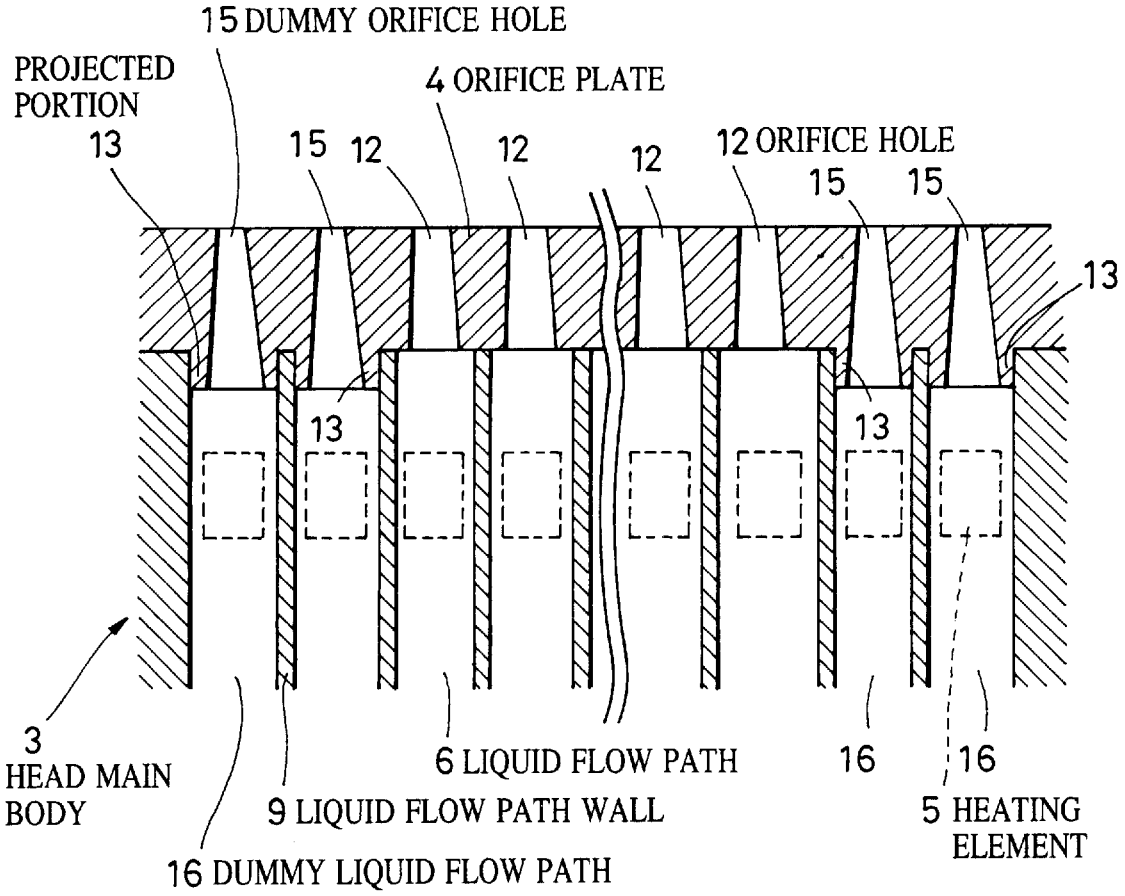
FIG. 8 is a cross sectional view schematically indicating a condition in which the orifice plate has been combined on to the head main body.

Next, the combination of the orifice plate 4 with the head main body 3 will be described with reference to FIG. 8 which is a cross sectional view indicating a liquid discharge head formed by combining together the orifice plate 4 and the head main body 3. In detail, FIG. 8 is a cross sectional view which indicates a liquid discharge head with its central part broken for clear indication. In more detail, FIG. 8 shows that there are two dummy orifice holes 15 on either side of a plurality of the orifice holes.

At first, the projected portions 13 corresponding to the dummy orifice holes 15 are engaged with the dummy liquid flow paths 16 formed within the head main body 3, thereby completing the positioning of the orifice plate 4 on the head main body 3.

Subsequently, a pressure of 1 kg/cm$^2$ is applied to the orifice plate 4 against the head main body 3, so as to cause the orifice plate 4 to be firmly attached on to the head main body 3. Then, a heat pressing treatment is carried out with the use of a heat of 60° C., so that the adhesive agent 14 is hardened and thus the orifice plate 4 and the head main body 3 get firmly combined with each other. In this way, as shown in FIG. 8, the orifice plate 4 and the head main body 3 are allowed to be combined together under a condition in which the liquid flow paths 6 and the orifice holes 12 are engaged with each other at a high precision. However, in FIG. 8, the adhesive resin 14 is not shown.

In the above described method, since the orifice holes 12 are formed by virtue of laser treatment before the head main body 3 are combined with the orifice plate 4, there would be no extraneous materials such as carbon material caused due to ablation of laser treatment, thus it is not necessary to worry about an invasion of the extraneous materials into the liquid flow paths 6. Therefore, it is sure to prevent a possible blockage of the orifice holes 12 which will otherwise be caused due to the invasion of extraneous materials. Thus, there would be no attachment of the extraneous material on to the heating elements 5, thereby exactly preventing any failure discharge of the ink from the discharge head.

Although it has been described in the present embodiment that two dummy orifice holes 15 and two dummy liquid flow paths 16 are provided on either side of the plurality of the liquid flow paths 6, the present invention should not be limited to such a specific example. In fact, it is also possible to provide three dummy orifice holes 15 and three dummy liquid flow paths 16 on either side of the plurality of the liquid flow paths 6.

As described in the above, according to the present embodiment, the projected portions 13 surrounding the dummy orifice holes 15 are engaged with the dummy liquid flow paths 16 of the head main body 3 so as to complete the predetermined positioning, thereby effecting the combination of the orifice plate 4 with the head main body 3. In this way, even if the liquid flow paths 6 are arranged with a high density, the orifice plate 4 will be allowed to be combined with the head main body 3 with a great ease under a condition in which the orifice holes 12 and the liquid flow paths 6 are engaged with each other at a high precision. Further, since the projected portions 13 are positioned on either side of the plurality of the liquid flow paths 6, even if there is a large difference between the linear expansion coefficient of the orifice plate and that of the head main body, it is still possible to effectively inhibit a possible deformation of the orifice plate, thereby making it sure to greatly reduce a possible deviation of the orifice plate which will otherwise be caused due to temperature change.

Second Embodiment

Figure 9A:
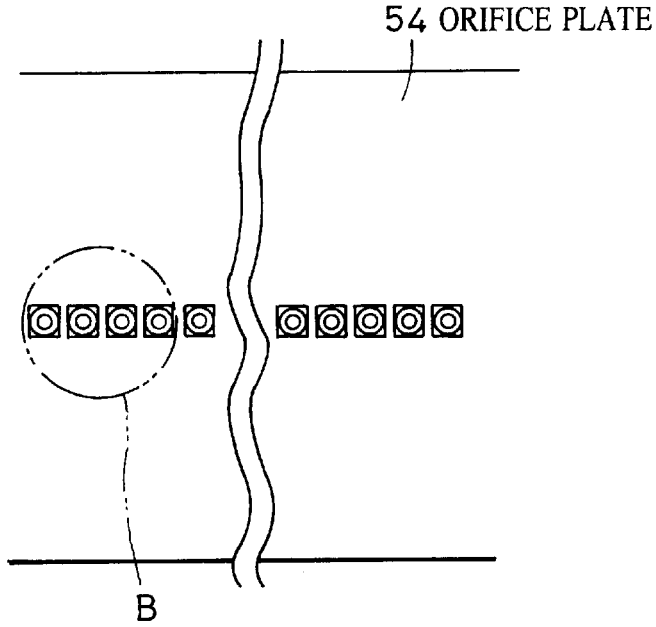
FIG. 9A is a plane view partially indicating an orifice plate for use in a liquid discharge head made according to a second embodiment of the present invention.
Figure 9B:
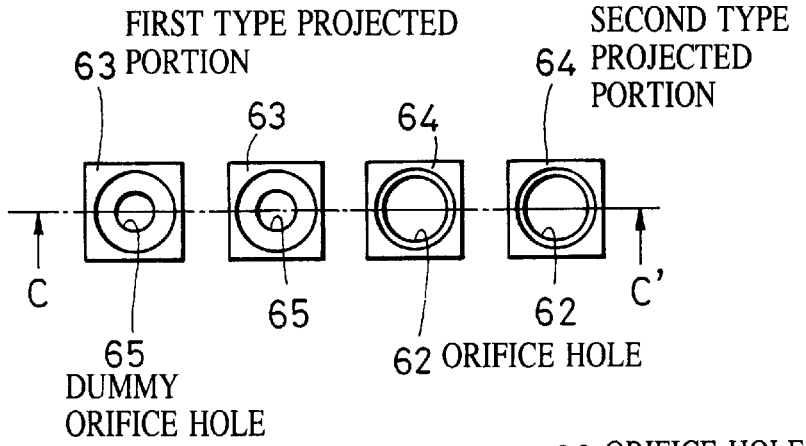
FIG. 9B is a plane view in which B portion of FIG. 9A has been enlarged.
Figure 9C:
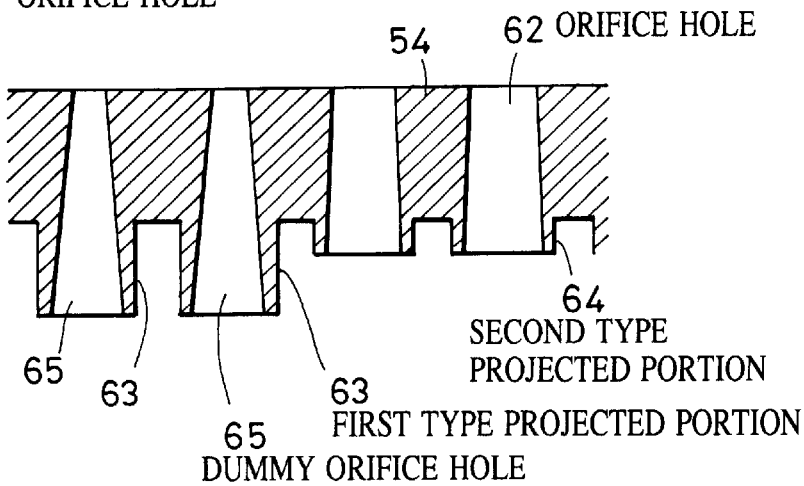
FIG. 9C is a cross sectional view taken along C–C' line in FIG. 9B.

FIG. 9A is a plane view partially indicating an orifice plate 54 for use in a liquid discharge head made according to the present embodiment. FIG. 9B is a plane view in which B portion of FIG. 9A has been enlarged. FIG. 9C is a cross sectional view taken along C–C' line in FIG. 9B.

As shown in the drawings, the orifice plate 54 has first type projected portions 63 corresponding to dummy orifice holes 65, also has a plurality of second type projected portions 64 corresponding to various other orifice holes 62. In practice, the first type projected portions 63 are so formed that they have a height higher than that of the second type projected portions 64.

Since the liquid discharge head of the second embodiment is almost the same as the liquid discharge head of the first embodiment except the above described structures, the detailed description of the liquid discharge head of the second embodiment will be omitted here.

Figure 10A:
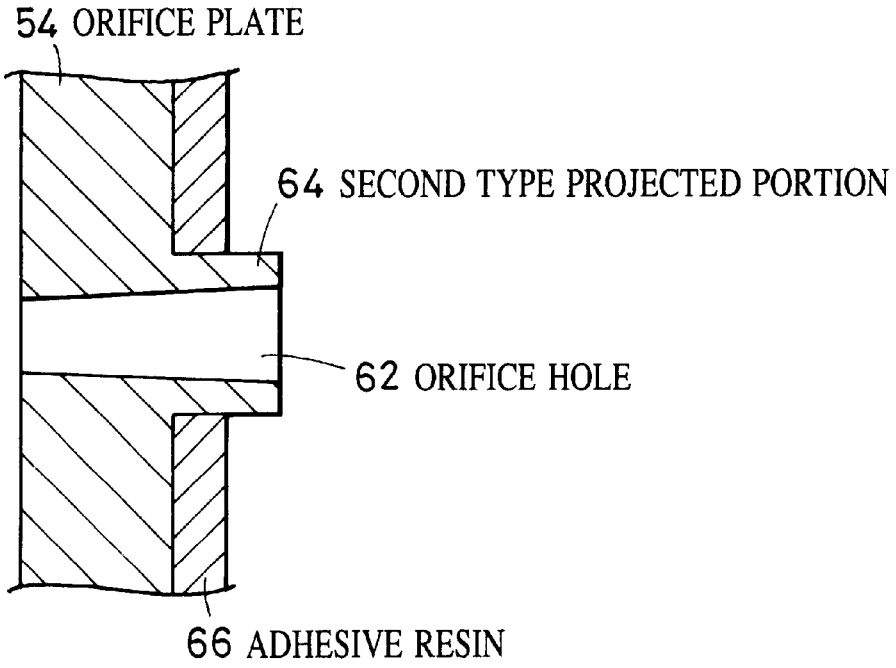
FIG. 10A is a cross sectional view schematically indicating a portion located in the vicinity of an orifice hole of the orifice plate which has been coated with an adhesive agent.
Figure 10B:
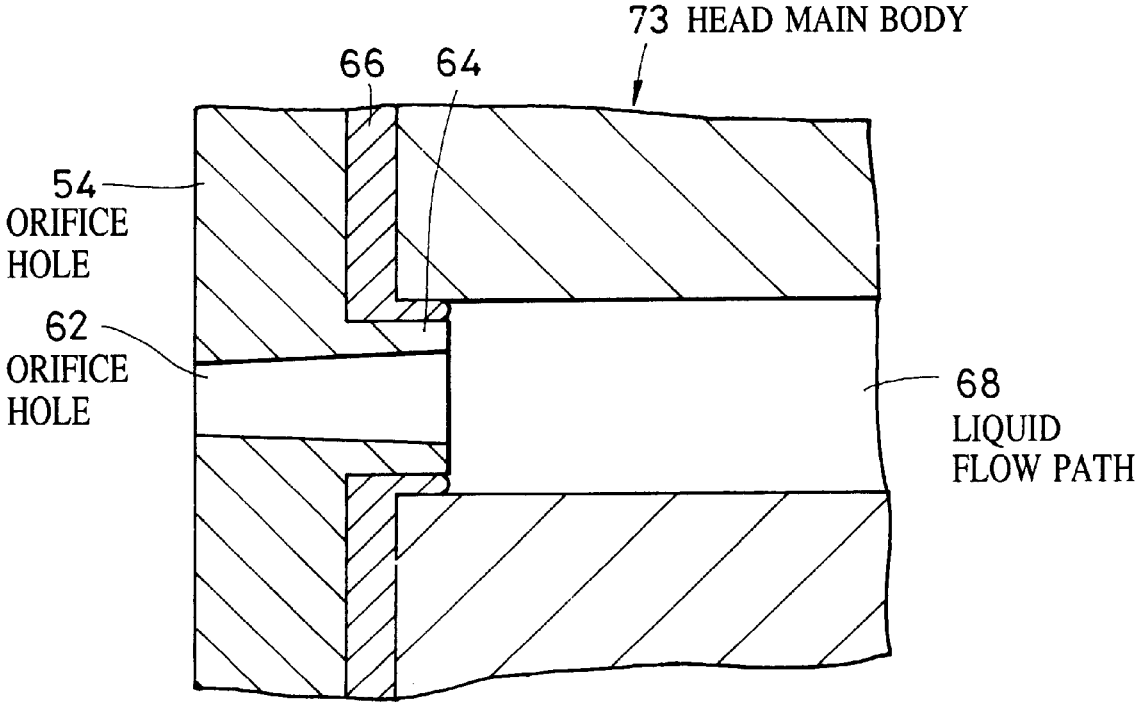
FIG. 10B is a cross sectional view schematically indicating a portion located in the vicinity of an orifice of the orifice plate which has already been combined with a head main body.

FIG. 10A is a cross sectional view schematically indicating a portion located in the vicinity of an orifice hole 62 of the orifice plate 54 which has been coated with an adhesive agent 66. FIG. 10B is a cross sectional view schematically indicating a portion located in the vicinity of an orifice 62 of the orifice plate which has already been combined with a head main body 73. Therefore, the combination of the orifice plate with the head main body will be described with reference to these drawings.

At first, the first type projected portions 63 corresponding to the dummy orifice holes 65, are engaged with the dummy liquid flow paths (not shown) formed in the head main body 73, thereby effecting a predetermined positioning of the orifice plate 54 on the head main body 73.

Then, the first type projected portions 63 are pushed further into the dummy liquid flow paths, while the second type projected portions 64 corresponding to the orifice holes 62 are engaged with the opening ends of the liquid flow paths 68 of the head main body 73. Subsequently, a pressure of 1 kg/cm$^2$ is applied to the orifice plate 54 against the head main body 73, so as to cause the orifice plate 54 to be firmly combined with the head main body 73. Then, a heat pressing treatment is carried out with the use of a heat of 60° C., so that the adhesive resin 66 is hardened and thus the orifice plate 54 and the head main body 73 get firmly combined with each other. In this way, as shown in FIG. 10B, the orifice plate 54 and the head main body 73 are allowed to be combined together by completing the hardening of the adhesive resin 66. Therefore, as shown in FIG. 10B, the head main body 73 and the orifice plate 54 may be firmly combined together by virtue of the adhesive resin 66.

Further, as may be understood from FIG. 10B, even if the adhesive resin 66 can partially invade into the liquid flow paths 68 during a process in which the orifice plate 54 is pressed on to the head main body 73, since the second type projected portions 64 have been provided on the orifice plate 54, the adhesive resin 66 enters only the gaps formed between the outer circumferential walls of the projected portions 64 and the liquid flow paths 68, thereby preventing a possible invasion of the adhesive resin 66 into the orifice holes 62. As a result, it is sure to prevent a failure ink discharge which will otherwise be caused due to an invasion of the adhesive resin 66 into the orifice holes 62. Further, since the orifice holes 62 are formed by virtue of laser treatment before the head main body 73 is combined with the orifice plate 54, there would be no extraneous materials such as carbon material which would otherwise be caused due to an ablation of laser treatment, thus it is not necessary to worry about an invasion of the extraneous materials into the liquid flow paths 68. Therefore, it is sure to prevent a possible blockage of the orifice holes 62 which will otherwise be caused due to the invasion of extraneous materials. Thus, there would be no attachment of the extraneous material on to the heating elements, thereby exactly preventing failure discharge of the ink from the discharge head.

Although it has been described in the present embodiment that two dummy orifice holes 65 and two dummy liquid flow paths (not shown) are provided on either side of the plurality of the liquid flow paths 68, the present invention should not be limited to such a specific example. In fact, it is also possible to provide one, three or more than three dummy orifice holes 65 and one, three or more than three dummy liquid flow paths (not shown) on either side of the plurality of the liquid flow paths 68.

As described in the above, according to the present embodiment, the projected portions 63 surrounding the dummy orifice holes 65 are engaged with the dummy liquid flow paths (not shown) of the head main body 73 so as to complete the predetermined positioning, thereby effecting the combination of the orifice plate 54 with the head main body 73. In this way, even if the liquid flow paths 68 are arranged with a high density, the orifice plate 54 will be allowed to be combined with the head main body 73 with a great ease under a condition in which the orifice holes 62 and the liquid flow paths 68 are engaged with each other at a high precision. Further, in the present embodiment, since it is possible to prevent an invasion of the adhesive resin 66 into the gaps formed between the outer circumferential walls of the second type projected portions 64 and the liquid flow paths 66, it is sure to prevent the adhesive resin 66 from invading into the orifice holes 62.

Third Embodiment

Next, description will be given to a liquid discharge head made according to a third embodiment of the present invention.

In the above first and second embodiments, all the liquid flow paths 6 communicate with a single common liquid chamber 7, and only one kind of liquid is discharged from the orifice holes 12. But, it is also possible that the common liquid chamber may be divided into a plurality of smaller rooms, so that several different kinds of liquids are allowed to flow from the orifice holes into these small rooms by way of several liquid flow paths corresponding to these smaller rooms (for example, the common liquid chamber can be divided into three smaller rooms, three colors of inks including yellow, magenta and cyan may be discharged from one row of the orifice holes). At this time, between groups of orifice holes capable of discharging inks of different colors, it is allowed to provide projected portions which can be engaged with the head main body, just like the above described projected portions 13 and the first type projected portions 63 as illustrated in the first and second embodiments. On the main head bodies capable of engaging with the projected portions, if the liquid flow paths have the same configurations as that of the liquid flow path 6 shown in the first embodiment, it is easy to form an engagement between the projected portions and the liquid flow paths. However, in the projected portions provided between groups of orifice holes, it is also allowed to form dummy orifice holes which are similar to the dummy orifice holes 15 and 65 used in the first and second embodiments.

Since the liquid discharge head of the present embodiment is almost the same (especially the combining relationship between the orifice plates and the head main bodies) as the liquid discharge heads shown in the first and second embodiments except the above discussed portions, the detailed description thereof is omitted here.

Further, similar to the above second embodiment, it is possible that projected portions may also be formed around other orifice holes (not shown) capable of discharging ink.

As described in the above, according to the present embodiment which is similar to the above first and second embodiments, the projected portions provided between the groups of orifice holes may be engaged with the liquid flow paths (of a head main body) similar to the liquid flow paths in the above first embodiment, so as to complete the predetermined positioning, thereby effecting the combination of the orifice plate with the head main body. In this way, even if the liquid flow paths are arranged with a high density, the orifice plate will be allowed to be combined with the head main body with a great ease under a condition in which the orifice holes and the liquid flow paths are engaged with each other at a high precision. Further, when projected portions are also formed around orifice holes (not shown) capable of discharging ink, it is sure to prevent the adhesive resin (not shown) from invading into the orifice holes, in the similar manner as that in the above second embodiment.

Next, detailed description will be given to a head cartridge and a liquid discharge recording apparatus all formed by using one of the liquid discharge heads shown in the first to third embodiments.

Figure 11:
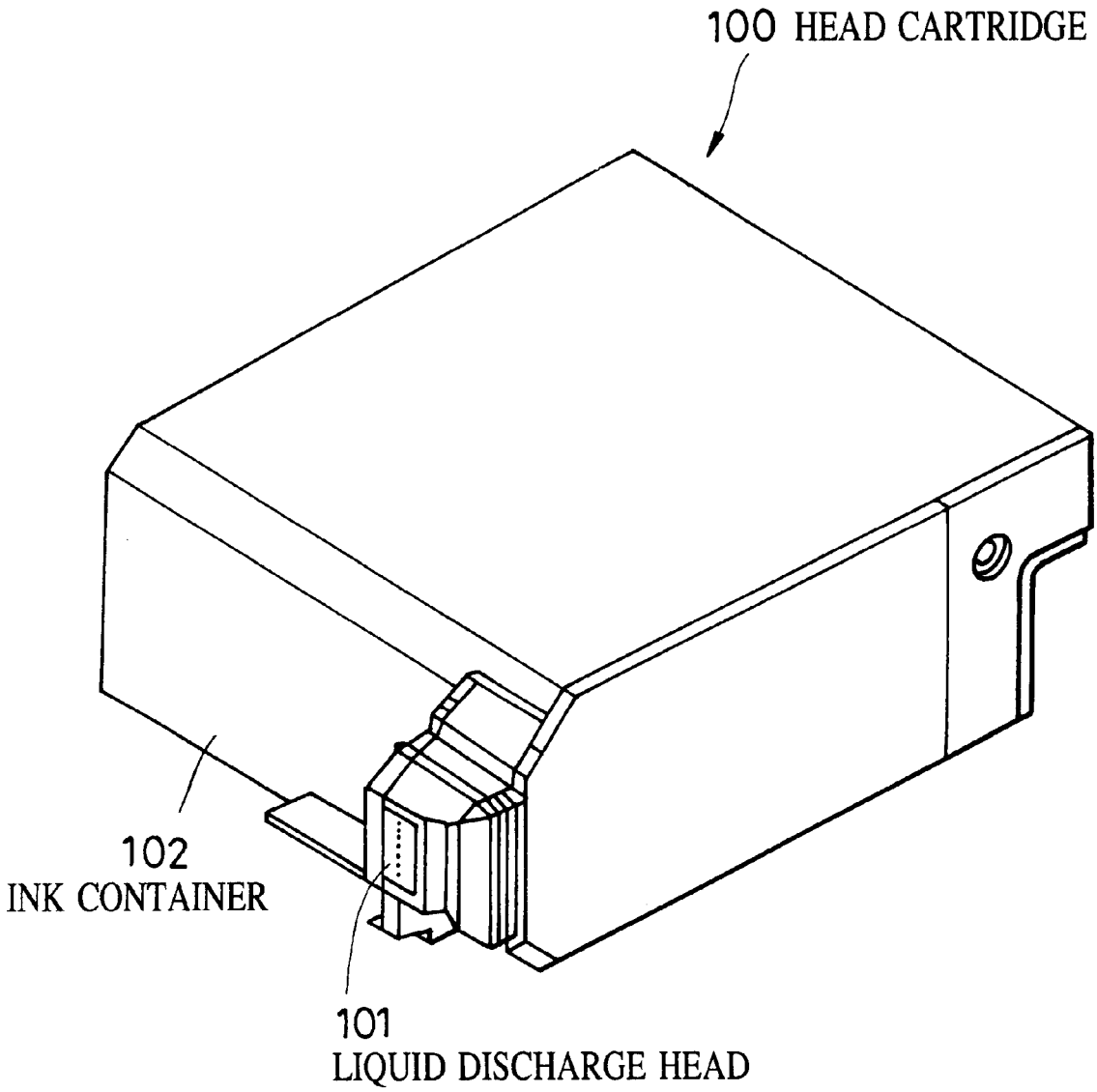
FIG. 11 is a perspective view schematically indicating one example of a head cartridge formed by using a liquid discharge head made according to the present invention.

FIG. 11 is a perspective view schematically indicating one example of a head cartridge formed by using a liquid discharge head made according to the present invention. As shown in the drawing, a head cartridge 100 comprises a liquid discharge head 101 which is the same as indicated in the previous embodiment, an ink container 102 for holding an amount of ink to be supplied to the liquid discharge head. In fact, the liquid discharge head 101 and the ink container 102 are formed integrally with each other in the head cartridge. However, the ink container 102 is so formed that it can be filled again after each ink consumption.

Figure 12:
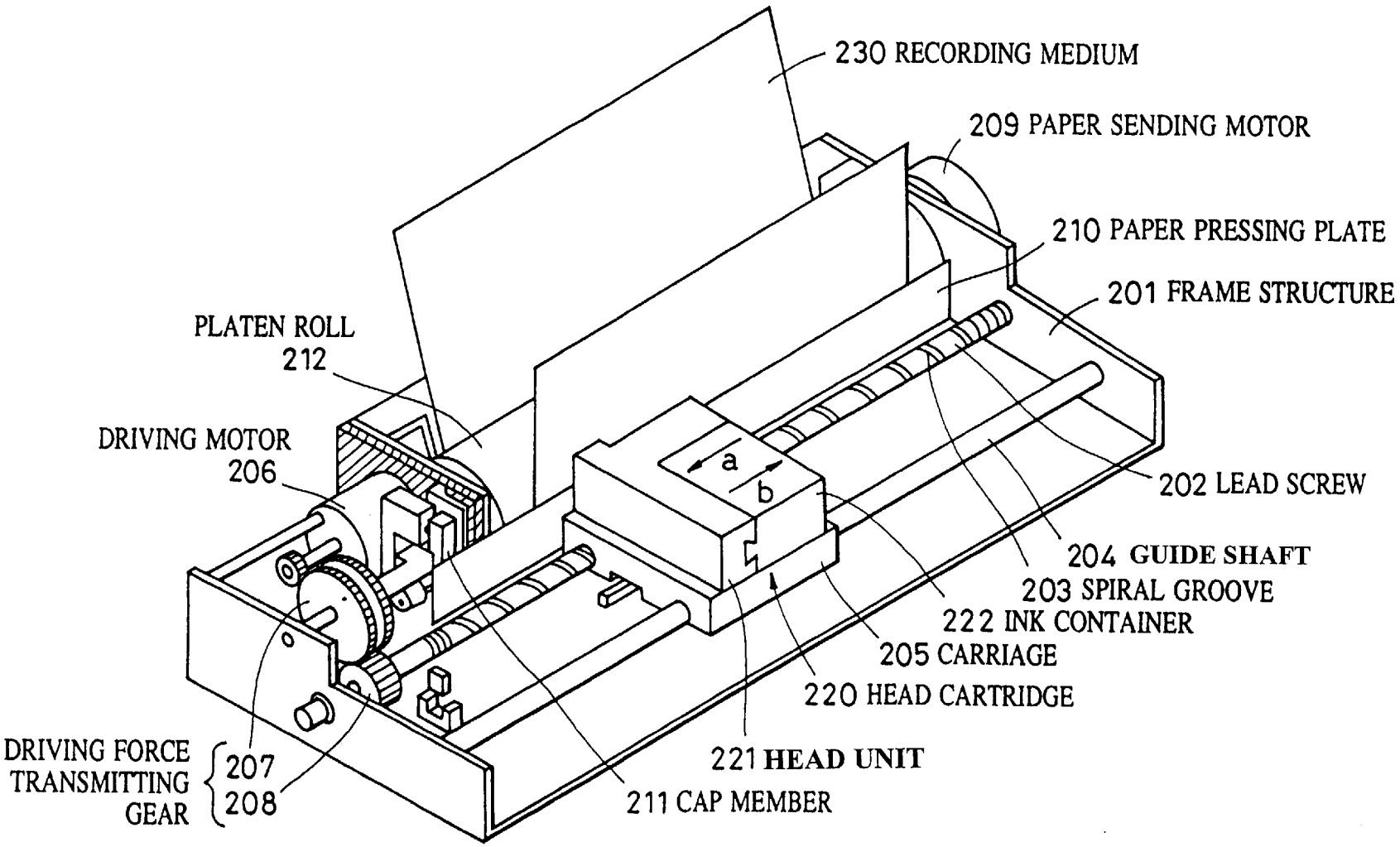
FIG. 12 is a perspective view schematically indicating a cylinder type liquid discharge recording apparatus formed by using a liquid discharge head made according to the present invention.

FIG. 12 is a perspective view schematically indicating a cylinder type liquid discharge recording apparatus formed by using a liquid discharge head made according to the present invention. As shown in FIG. 12, the liquid discharge recording apparatus is comprised of a frame structure 201. A lead screw 202 having a spiral groove 203 carved thereon is rotatably supported within the frame structure 201. Also supported within the frame structure 201 is a guide shaft 204 arranged in parallel with the lead screw 202. A carriage 205 is engaged with the spiral groove 203 by virtue of a pin (not shown). The carriage 205 is slidably guided by the guide shaft 204, so that the rotation of the driving motor 206 in either direction may be transmitted to the lead screw 202 by way of a driving force transmitting gears 207 and 208, thereby causing the carriage 205 to reciprocatingly move in direction a or direction b.

In detail, the carriage 205 is comprised of a head cartridge 220 which is detachably attached on the guide shaft and the lead screw. In more detail, the head cartridge 220 includes a head unit 221 having a liquid discharge head illustrated in any one of the above embodiments, and an ink container 222 capable of supplying ink to the liquid discharge head. In further detail, the head unit 221 and the ink container 222 are mutually separable. Here, as the head cartridge 220, it is allowed to use a device as shown in FIG. 11, which includes the liquid discharge head 101 and the ink container 102 that are integrally assembled together and can not be separated from each other.

A paper pressing plate 210, which acts in the moving direction of the carriage 205, is used to press a recording medium 230 against a platen roll 212 which is rotated by a paper sending motor 209. In this way, with the rotation of the platen roll 212, the recording medium 230 is transported by virtue of a friction force generated between the platen roll 212 and the recording medium 230. Then, when the carriage 205 is reciprocated back and forth while the recording medium 230 is pitch-sent, the ink will be discharged towards the liquid discharge head, thereby effecting a recording operation on the recording medium 230.

Further, when the carriage 205 is located in its home position, a cap member 211 for covering the front portion (the surface of the orifice plate) of the liquid discharge head will be located in a position facing the front portion of the liquid discharge head. The cap member 211 is connected with a suction means (not shown). With the front portion of the liquid discharge head being covered by the cap member, the suction means is driven so that a suction operation can be carried out to ensure that the extraneous materials or thick ink may be sucked forcefully, thereby maintaining a desired discharge characteristic of the liquid discharge head.

Figure 13:
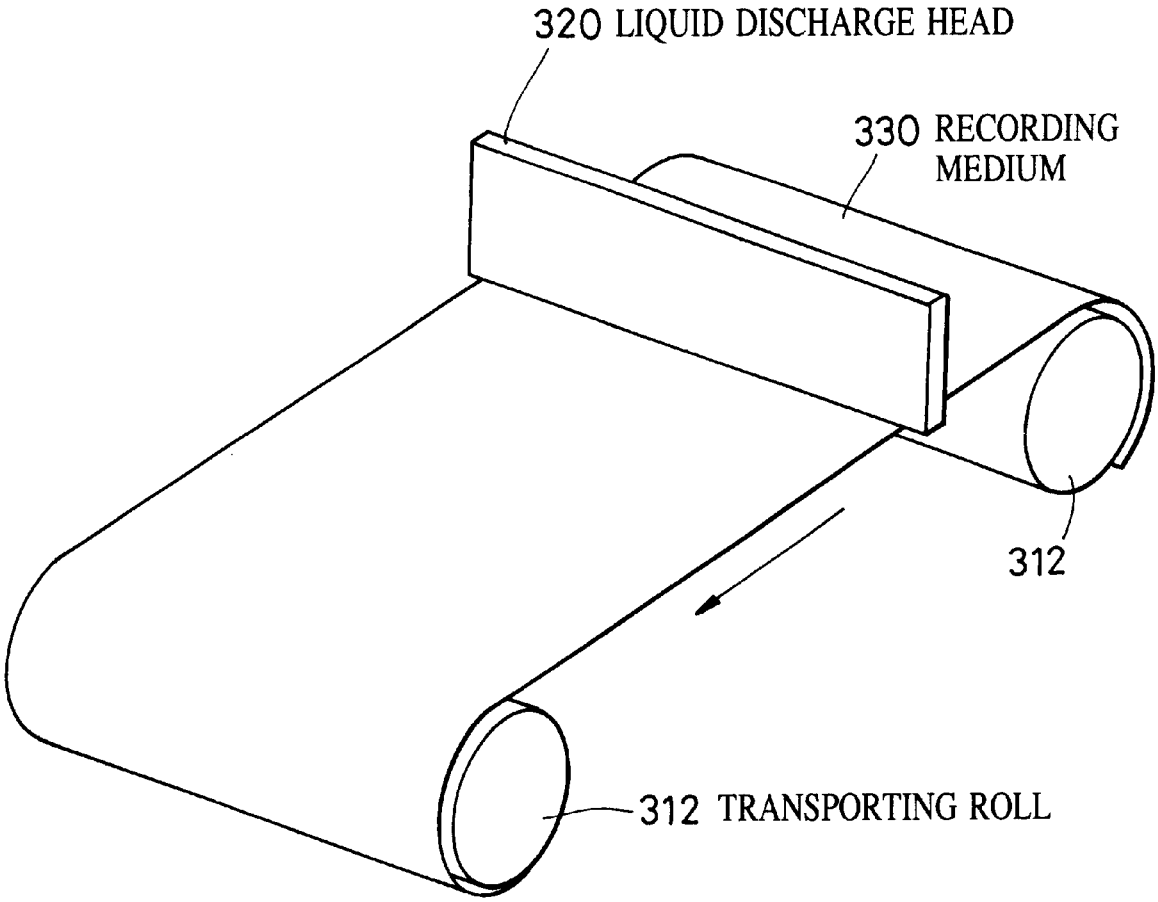
FIG. 13 is a perspective view schematically indicating a full line type liquid discharge recording apparatus formed by using a liquid discharge head of the present invention.
Figure 14:
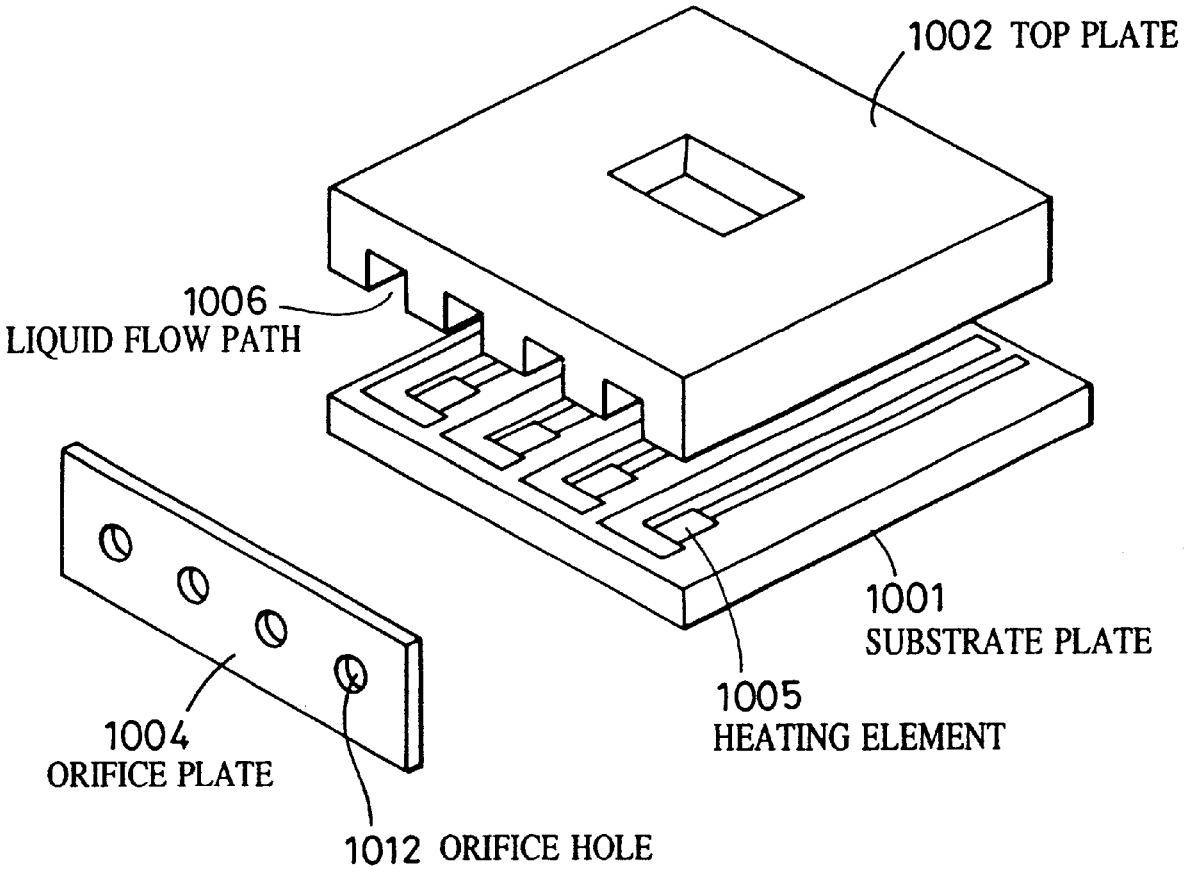
FIG. 14 PRIOR ART
FIG. 14 is an exploded perspective view schematically indicating one example of a conventional liquid discharge head.
Figure 15:
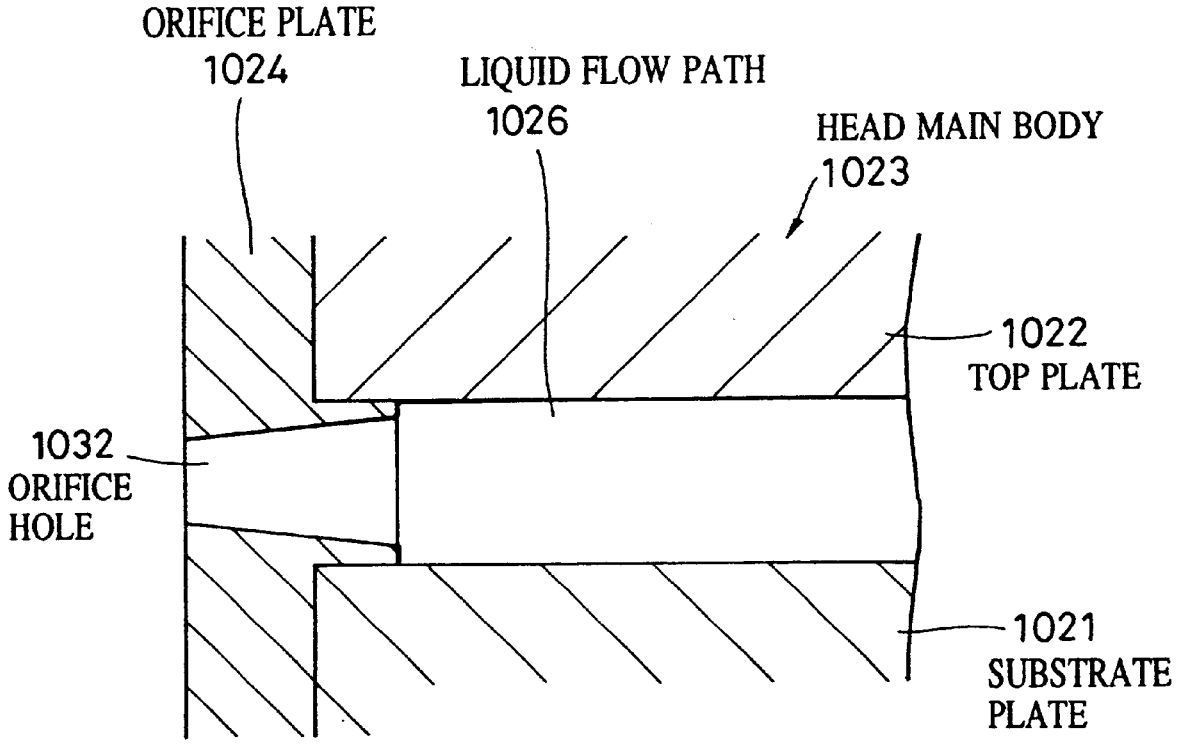
FIG. 15 PRIOR ART
FIG. 15 is a cross sectional view taken along a line located in the vicinity of an orifice plate, indicating another example of a conventional liquid discharge head.

FIG. 13 is a perspective view schematically indicating a full line type liquid discharge recording apparatus formed by using a liquid discharge head of the present invention. In detail, the liquid discharge recording apparatus shown in FIG. 13 is equipped with a liquid discharge head 320 facing a recording medium 330 transported by two transporting rollers 312. The liquid discharge head 320 has the same structure as described in any of the above embodiments, and is formed with a plurality of orifice holes arranged along an entire length of a recordable area of the recording medium. In this way, with the use of a liquid discharge head of the present invention, it is easy to effect the positioning of the orifice plate with respect to the head main body, simply through an engagement of the projected portions (in which dummy orifice holes have been formed) with the dummy liquid flow paths. Therefore, even with an elongated liquid discharge head having a shape like full line head, it is still possible to ensure a high precision when positioning the orifice holes with respect to the liquid flow paths.

What is claimed is:

1. A liquid discharge head equipped with a plurality of energy generating elements capable of generating energy for use in liquid discharge, including a head main body having a plurality of liquid flow paths arranged in parallel with one another corresponding to the energy generating elements, said liquid flow paths having their openings formed on one end face of the head main body, further including an orifice plate having a plurality of orifice holes communicating with the liquid flow paths, so that the liquid discharge head is capable of performing a recording operation on a recording medium by discharging liquid through the orifice holes, wherein:

said head main body has a plurality of dummy liquid flow paths which will not be used in a recording operation but are provided on either side of the plurality of the liquid flow paths and are arranged in parallel with these liquid flow paths, while the orifice plate has, on its combining surface for combining with the head main body and only in positions corresponding to the dummy liquid flow paths, a first plurality of projected portions capable of engaging with open ends of the dummy liquid flow paths.

2. The liquid discharge head according to claim 1, wherein said orifice plate has, on its combining surface for combining with the head main body, a second plurality of projected portions for use with the orifice holes, said second plurality of projected portions being capable of engaging with opening ends of the liquid flow paths each associated with an orifice hole.

3. The liquid discharge head according to claim 2, wherein a height measured from the combining surface of the orifice plate to the first plurality of projected portions is higher than a height measured from the combining surface of the orifice plate to the second plurality of projected portions formed for use with the orifice holes.

4. The liquid discharge head according to claim 1, wherein the orifice holes have been divided into a plurality of orifice groups capable of discharging several kinds of different liquids, and engaging portions for engaging the orifice plate with the head main body are formed between the several orifice groups on the orifice plate.

5. A liquid discharge recording apparatus, comprising a transporting means for transporting a recording medium, and a holding means for holding a liquid discharge head as recited in any one of claims 1 and 2–4, said liquid discharge head being capable of discharging a liquid and performing a recording on the recording medium, said holding means being also capable of reciprocatingly moving the liquid discharge head in a direction perpendicular to a direction in which the recording medium is transported.

6. A liquid discharge head, equipped with a plurality of energy generating elements capable of generating energy for use in liquid discharge, including a head main body having a plurality of liquid flow paths arranged in parallel with one another corresponding to the energy generating elements, said liquid flow paths having their openings formed on one end face of the head main body, further including an orifice plate having a plurality of orifice holes communicating with the liquid flow paths, so that the liquid discharge head is capable of performing a recording operation on a recording medium by discharging liquid through the orifice holes, wherein:

said head main body has a plurality of dummy liquid flow paths which will not be used in a recording operation but are provided on either side of the plurality of the liquid flow paths and are arranged in parallel with these liquid flow paths, while the orifice plate has, on its combining surface for combining with the head main body and in positions corresponding to the dummy liquid flow paths, a plurality of projected portions capable of engaging with open ends of the dummy liquid flow paths, and wherein each of the projected portions is formed with a dummy orifice hole which is different from the orifice hole.

7. The liquid discharge head according to claim 6, wherein each of the orifice holes and the dummy orifice holes has been formed into a tapered configuration whose diameter becomes smaller along the liquid discharge direction.

8. The liquid discharge head according to claim 7, wherein each of the orifice holes and the dummy orifice holes has been formed by means of laser light irradiating through the combining surface.

9. A liquid discharge recording apparatus, comprising a transporting means for transporting a recording medium, and a holding means for holding a liquid discharge head as recited in any one of claims 6, 7 and 8, said liquid discharge head being capable of discharging a liquid and performing a recording on the recording medium, said holding means being also capable of reciprocatingly moving the liquid discharge head in a direction perpendicular to a direction in which the recording medium is transported.

10. A method of manufacturing a liquid discharge head equipped with a plurality of energy generating elements capable of generating energy for use in liquid discharge, including a head main body having a plurality of liquid flow paths arranged in parallel with one another corresponding to the energy generating elements, the liquid flow paths having their openings formed on one end face of the head main body, further including an orifice plate having a plurality of orifice holes communicating with the liquid flow paths, so that the liquid discharge head is capable of performing a recording operation on a recording medium by discharging liquid through the orifice holes; said method comprising the steps of:

forming a plurality of dummy liquid flow paths which are provided on either side of the plurality of the liquid flow paths and are arranged in parallel with these liquid flow paths;

forming a first plurality of projected portions capable of engaging with open ends of the dummy liquid flow paths, with the projected portions located only in positions corresponding to the dummy liquid flow paths and formed on the orifice plate's combining surface for combining with the head main body; and combining the orifice plate with the head main body after the projected portions are combined with the open ends of the dummy liquid flow paths for effecting the positioning of the liquid flow paths with respect to the orifice holes.

11. A method of manufacturing a liquid discharge head according to claim 10, comprising:

a step in which said orifice plate is formed, on its combining surface for combining with the head main body, with a plurality of projected portions capable of engaging with opening ends of the liquid flow paths each associated with an orifice hole; and another step, in which each projected portion for use with an orifice hole is formed with an orifice hole.

12. A method of manufacturing a liquid discharge head according to claim 10, comprising a step in which the orifice holes are divided into a plurality of orifice groups capable of discharging several kinds of liquids, and engaging portions for engaging the orifice plate with the head main body are formed between the several orifice groups on the orifice plate.

13. A method of manufacturing a liquid discharge head equipped with a plurality of energy generating elements capable of generating energy for use in liquid discharge, including a head main body having a plurality of liquid flow paths arranged in parallel with one another corresponding to the energy generating elements, the liquid flow paths having their openings formed on one end face of the head main body, further including an orifice plate having a plurality of orifice holes communicating with the liquid flow paths, so that the liquid discharge head is capable of performing a recording operation on a recording medium by discharging liquid through the orifice holes; said method comprising the steps of:

forming a plurality of dummy liquid flow paths which are provided on either side of the plurality of the liquid flow paths and are arranged in parallel with these liquid flow paths;

forming a plurality of projected portions capable of engaging with open ends of the dummy liquid flow paths, with the projected portions located in positions corresponding to the dummy liquid flow paths and formed on the orifice plate's combining surface for combining with the head main body; and combining the orifice plate with the head main body after the projected portions are combined with the open ends of the dummy liquid flow paths for effecting the positioning of the liquid flow paths with respect to the orifice holes, wherein each of the projected portions is formed with a dummy orifice hole which is different from the orifice hole.

14. A method of manufacturing a liquid discharge head according to claim 13, wherein each dummy orifice hole is formed in an orifice hole formation process which is carried out prior to the combining process for combining the orifice plate on to the head main body.

15. A method of manufacturing a liquid discharge head according to claim 13, comprising a step in which each of the orifice holes and the dummy orifice holes is formed into a tapered configuration whose diameter becomes smaller along the liquid discharge direction.

16. A method of manufacturing a liquid discharge head according to claim 15, comprising a step in which each of the orifice holes and the dummy orifice holes is formed by means of laser light irradiating through the combining surface.

17. A method of manufacturing a liquid discharge head equipped with a plurality of energy generating elements capable of generating energy for use in liquid discharge, including a head main body having a plurality of liquid flow paths arranged in parallel with one another corresponding to the energy generating elements, the liquid flow paths having their openings formed on one end face of the head main body, further including an orifice plate having a plurality of orifice holes communicating with the liquid flow paths, so that the liquid discharge head is capable of performing a recording operation on a recording medium by discharging liquid through the orifice holes; said method comprising the steps of:

forming a plurality of dummy liquid flow paths which are provided on either side of the plurality of the liquid flow paths and are arranged in parallel with these liquid flow paths;

forming a plurality of projected portions capable of engaging with open ends of the dummy liquid flow paths, with the projected portions located in positions corresponding to the dummy liquid flow paths and formed on the orifice plate's combining surface for combining with the head main body;

combining the orifice plate with the head main body after the projected portions are combined with the open ends of the dummy liquid flow paths for effecting the positioning of the liquid flow paths with respect to the orifice holes; and making a height measured from the combining surface of the orifice plate to the projected portions higher than a height measured from the combining surface of the orifice plate to the projected portions formed for use with the orifice holes.

* * * * *

UNITED STATES PATENT AND TRADEMARK OFFICE

CERTIFICATE OF CORRECTION

PATENT NO. : 6,431,682 B1 
DATED : August 13, 2002
INVENTOR(S) : Torachika Osada et al.

It is certified that error appears in the above-identified patent and that said Letters Patent is hereby corrected as shown below:

Title page,
Item [57], ABSTRACT,
Line 6, "In detail," should read -- Specifically, --; and "body is formed on the lower wall" should read -- body, on a bottom wall of which --;
Line 7, "thereof" should be deleted; and "elements," should read -- elements are formed, --; and
Line 9, "and" should be deleted.

Drawings,
Sheet 6, Figure 7, "EXIMA" should read -- EXCIMER --; and "LENSE" should read -- LENS --.

Column 1,
Line 10, "great" should read -- a great --;
Line 16, "(herein after," should read -- (hereinafter --; and
Line 37, "14," should read -- 14 --.

Column 2,
Line 53, "portions" should read -- portion --;
Line 63, "film," should read -- film, and --;
Line 64, "a heat," should read -- heat --; and
Line 65, "then" should be deleted.

Column 3,
Line 56, "invention," should read -- invention --.

Column 5,
Line 37, "respectively" should be deleted;
Line 38, "each formed by" should be deleted; and "C—C line" should read -- line C—C --;
Line 39, "FIG. 5C;" should read -- FIG. 5C, respectively; --; and
Line 45, "exima" should read -- excimer --.

Column 6,
Line 36, "can not be actually" should read -- cannot actually be --; and
Line 49, "kind of" should be deleted.

UNITED STATES PATENT AND TRADEMARK OFFICE

CERTIFICATE OF CORRECTION

PATENT NO. : 6,431,682 B1
DATED : August 13, 2002
INVENTOR(S) : Torachika Osada et al.

It is certified that error appears in the above-identified patent and that said Letters Patent is hereby corrected as shown below:

Column 7,
Line 61, "each" should read -- and each --.

Column 8,
Line 31, "dummy" should read -- dummy orifice --.

Column 9,
Line 63, "are" should read -- is --.

Column 13,
Line 14, "of a" should read -- of --; and
Line 26, "can not" should read -- cannot --.

Signed and Sealed this

Fifteenth Day of April, 2003

JAMES E. ROGAN
*Director of the United States Patent and Trademark Office*